United States Patent [19]

Al Haj Issa

[11] 3,934,386

[45] Jan. 27, 1976

[54] METHOD FOR MANUFACTURING OF ROOFS

[75] Inventor: Saher Al Haj Issa, Bochum, Germany

[73] Assignees: Saher Al Haj Issa; Ali Abdulla Essa Almannai, both of Cologne, Germany

[22] Filed: Nov. 15, 1974

[21] Appl. No.: 523,963

Related U.S. Application Data

[62] Division of Ser. No. 365,797, May 31, 1973, Pat. No. 3,866,385.

[30] Foreign Application Priority Data

June 2, 1972 Germany ..... 2226690

[52] U.S. Cl. ..... 52/747; 52/747 X

[51] Int. Cl.[2] ..... E04B 1/35

[58] Field of Search ..... 52/741, 745, 747

[56] References Cited

UNITED STATES PATENTS

| | | | |
|---|---|---|---|
| 3,018,546 | 1/1962 | Dewese | 52/747 X |
| 3,268,999 | 8/1966 | Wiggins | 52/745 X |
| 3,331,181 | 7/1967 | Schmidt | 52/747 |
| 3,333,322 | 8/1967 | Toffolon | 52/747 |
| 3,593,482 | 7/1971 | Johnson | 52/745 |

*Primary Examiner*—Price C. Faw, Jr.

*Attorney, Agent, or Firm*—Lowhurst, Aine & Nolan

[57] ABSTRACT

In a building construction method a plurality of building segments are coupled together and raised in unison from a central control point via a crane. The crane has a plurality of lifting cables selectively driven from a plurality of winches under the control of the operator. The building segments are pivotably coupled together for lifting into position and for locking together to form a rigid self supporting building structure. Successive layers of the building are hoisted into position via detachable pulleys affixed to the previously raised building segments.

5 Claims, 13 Drawing Figures

FIG.13
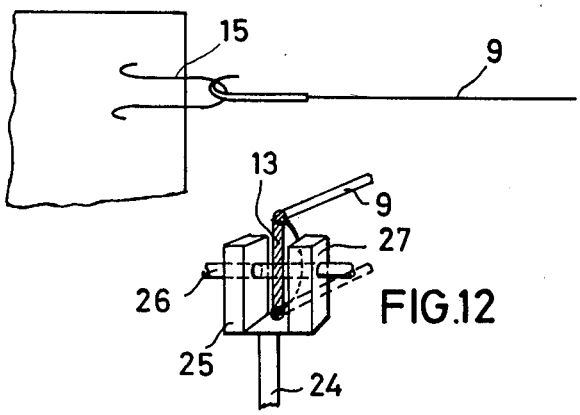
FIG.12
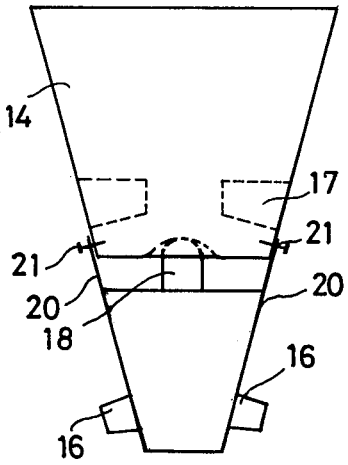
FIG.11

METHOD FOR MANUFACTURING OF ROOFS

This is a division of application Ser. No. 365,797, filed May 31, 1973, and now issued as U.S. Pat. No. 3,866,385, on Feb. 18, 1973.

This invention concerns a method for the production of roofs or the like, without the use of framework, in particular in the case of column-free workshops or factory halls (sheds) or the like, from singly or doubly curved roof shells, which are composed of individual shell elements.

It is usual to employ — in the case of these and similar building surfaces — the advantageous "curtain" assembly technique. This "curtain" constructional system eschews the use of rafters and posts and satisfies the requirements which have to be met in respect of weight. Better use is, certainly, made of building materials in this system. However, this "curtain" building system does not allow rapid working speeds to be achieved, and is labour-intensive. Also, assembly difficulties are experienced by reason of the relatively great height and span lengths of the roof or the like.

The invention has the object of removing these drawbacks and of simplifying assembly performance, while assembly still takes place without the use of scaffolding, and the "curtain" building technique can be employed substantially unimpaired. At the same time it is intended to reduce assembly time and the number of operatives employed in the assembly work, so that the latter may be carried out with the greatest possible efficiency and cheapness.

To this end it is proposed according to the invention: to commonly raise the shell elements — which have been symmetrically arranged in advance in one or more rows or rings — by pulling components, a respective one of which is associated with each of the shell elements and which are releasably coupled to the shell elements; to subsequently pivotably couple — when the shell elements have come into contact with a row of shell elements which have been previously assembled — the first-mentioned shell elements to the said row of previously assembled shell elements, or to suspend to first-mentioned shell elements on or in the said row of previously assembled shell elements; to then upwardly swivel the first-mentioned shell elements by subsequent actuation of the pulling components about an approximately horizontal axis, this upward swivelling motion of the shell elements continuing until their coupling components engage in one another and a vertical coupling action has been accomplished, and/or until the shell elements have assumed a predetermined angle of inclination. Thereafter all the shell elements are slowly swivelled together, preferably simultaneously, by virtue of the fact that the pulling components are appropriately shifted.

According to a modification of the invention, these working steps are controlled from a central control point, whereby the number of operatives used may be appreciably reduced, particularly in the case of large halls, sheds or workshops.

An apparatus for carrying out the proposed method comprises a crane, in particular a stationary mounted crane, the drive part (for example a toothed ring) of which — this crane has at least one such drive part — is connected, by way of a respective clutch, to rotatable winches, rollers or the like, the number of these winches being substantially the same as the number of shell elements belonging to a ring of shell elements or to a row of shell elements; and pulling cables or the like of the winches are releasably coupled to the shell elements, preferably at the end of these cables. In this way it is particularly easy to exercise centralised control over the assembly work.

According to one modification of the invention the winches and/or their clutches are so arranged, and/or so constructed, that all or some of the winches may be selectively driven. In this way it is possible to individually control the movements of the shell elements so that these movements are satisfactorily related to one another in terms of location and time, and also to assemble the shell elements so as to achieve the same result.

In the case of the shell elements for carrying out the method proposed according to the invention the horizontal couplings or joints consist of frusto-conical projections and of frusto-conical recesses in the adjacent shell element. This provides, relatively simply, a joint or coupling which presents adequate resistance to bending stresses. According to another embodiment of the invention an articulated joint is employed for the vertical coupling and may in particular be in the form of a head and of a socket located between adjacent shell elements. According to a further modification of the invention swivelling movements of the head part are simplified by the provision, as coupling elements for the swivelling movements, a sheet metal angle plate, in particular L-strip on one shell element and a co-operating pin, spindle or the like on the other shell element.

An embodiment of the invention is represented in the drawing and is described below. In the drawing:

FIG. 11 is a plan view of two consecutive shell elements corresponding to FIG. 4;

FIG. 12 is a fork for receiving an upper guide roller; for the sake of pictorial clarity the cables run parallel to each other; and FIG. 13 shows a shell element with fixing means into which the end of a cable or rope can be anchored.

Figure 2:
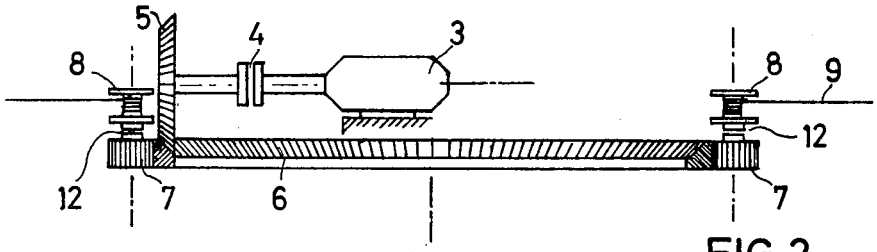
FIG. 2 is a side view of the crane shown in FIG. 1.
Figure 1:
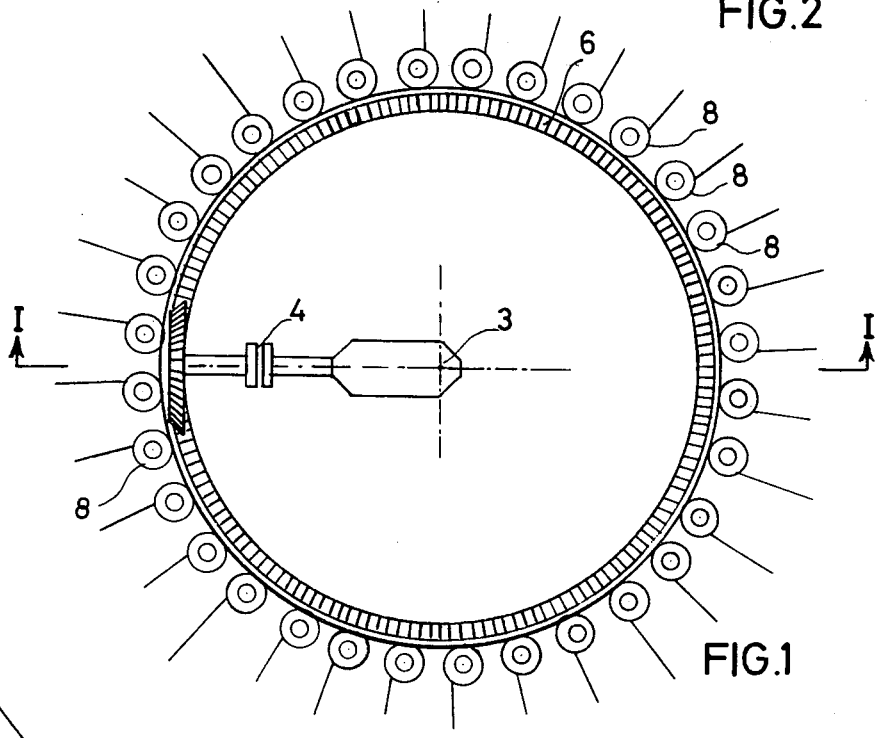
FIG. 1 illustrates the crane according to the invention, only the most important components being shown.
Figure 5:
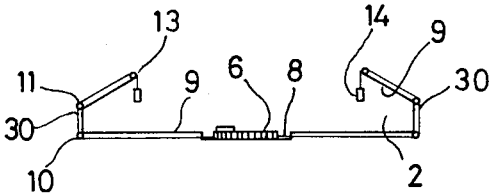
FIG. 5 is a side view, partially in section, of the overall lay-out of the multi-cable crane; only two of the plurality of cables provided are shown, together with their associated guide rollers, the co-operating walls, supports and/or completed rows.

As shown in FIG. 5, a multi-cable crane is mounted approximately in the centre of the hall or shed 2, which is to be covered over by the roof, and is driven by a suitable drive means, for example by an electric motor 3 (FIGS. 1,2). This drive to the multi-cable crane is transmitted by way of a clutch or coupling 4 and toothed wheel (preferably a helical gear wheel or pinion wheel 5). Thus, a gear ring (toothed rim) 6 of the multi-cable crane is caused to rotate and meshes with a number of driven toothed wheels 7, each of which is associated with a respective winch 8. The winches 8 are disposed about the toothed ring 6 and control the movement of cables 9. The cables 9 pass from the winches 8 to guide rollers 10, 11, (FIG. 5), which are positioned on supports or on the wall of the hall or shed; thence the cables 9 pass to the first roof shell, that is to say to the first row of roof shell elements. Each of the winches 8 is provided with a clutch 12. The clutch may be in the form of an electromagnetic clutch, which is remotely controllable, that is to say it can be engaged or disengaged from a remotely located control centre. Each of the clutches can be engaged or disengaged independently of the condition of the clutches 12 of the other winches 8. The drive 3 and clutches 12 can be controlled by an operative from a control console or panel. For example, the different actions may be initiated by acting on appropriate control knobs 3.

Figure 3:
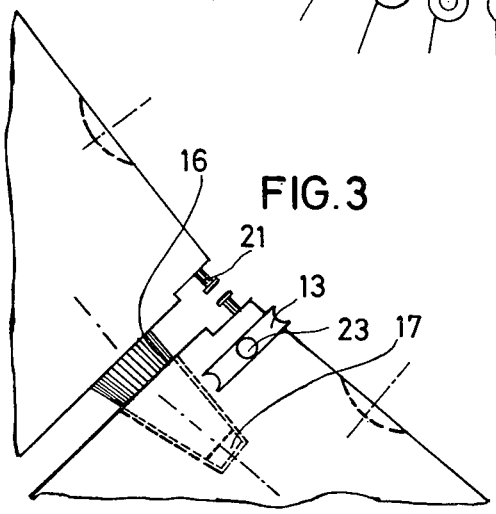
FIG. 3 is a plan view, in the ring — or horizontal plane, or two shell elements, which are in partial engagement with each other.
Figure 4:
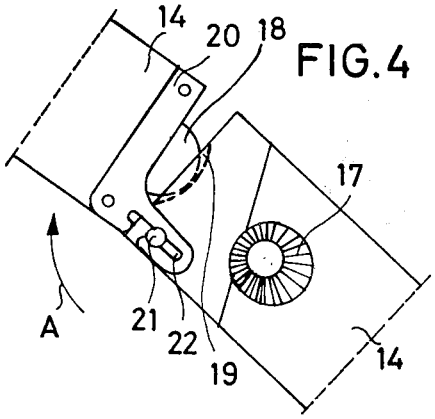
FIG. 4 is a side view of two adjacent shell elements, the upper of which has been upwardly swivelled and the coupling elements for effecting vertical coupling engaging in each other.
Figure 6:
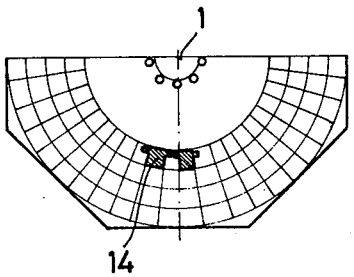
FIG. 6 is a plan view of half of a partially assembled roof, four roof shells being visible.

The upper guide roller 13 is releasably fixed in position, and has special functions to carry out. A shell element 14 is attached to the cable or rope 9, depending from the guide roller 13. For example, and as is illustrated in FIG. 13, the end of cable 9 is hooked in an eye 15. Examples of the type of building shell element which may be used are shown in FIGS. 3, 4 and 11. The shell elements may be of such a shape that the whole roof shell can be imagined as being split up by ring — and meridian-sections; this is best illustrated in FIG. 6. In the ring plane, illustrated in FIG. 3, a coupling joint is formed, between adjacent elements, so as to be resistant to any bending stresses applied to it. This joint consists of frusto-conical projections 16 and of associated frusto-conical holes 17. The vertical coupling or joint between adjacent shell elements is formed by hemispherical heads 18 and hemispherical sockets 19 (FIG. 4).

For the purpose of swivelling the upper shell elements, hooks are also arranged in the latter, for example L-shaped hooks 20 made of sheet metal, while pins 21 are provided on the other shell element 14. Elongate slots 22 formed in the L-shaped hooks 20 — which are themselves positioned at the lower edge of one of the shell elements — surround the pins 21, which are located on the upper edge of the other shell element.

As is diagrammatically illustrated in FIG. 3, the upper guide rollers 13 are installed by means of recesses 23, in which engage the supporting stems 24 (FIG. 12) of forked elements 25. The guide roller 13 is inserted between the arms of the forked element 25, and is then rotatably supported on the pin 26, which has also been placed in position between the arms of the forked element 25.

Figure 9:
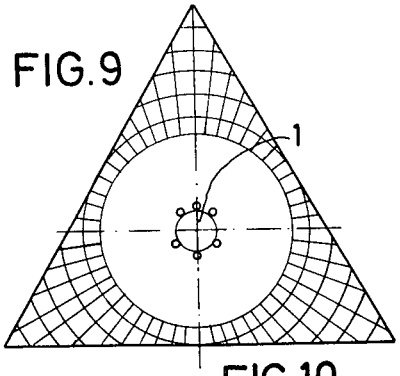
FIGS. 8 to 10 illustrate different shapes of roof, composed of suitable roof shells; the cooperating multi-cable crane is only shown in outline.
Figure 10:
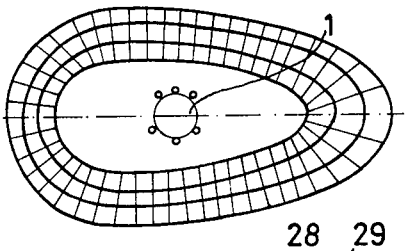
Figure 8:
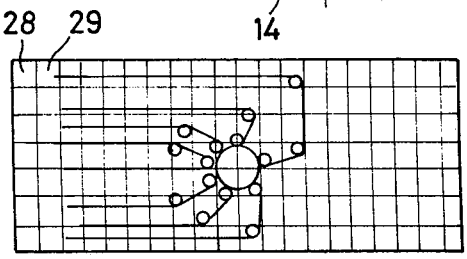

The cables or ropes 9 do not necessarily have to extend radially, in the manner shown in FIG. 5. Indeed, these cables 9 may extend approximately parallel to each other when, as in the case of the compass (barrel) roof illustrated in FIG. 8, the row or line of shell elements is not in the form of a ring, but approximately linearly disposed rows or lines of shell elements 28, 29 are successively installed. A more detailed account follows of the process according to the invention. Shell elements 14, which have been brought up by motorised vehicle, are placed down on the floor of the hall or shed 2 under a guide roller 13. The shell elements 14 are thus set down — approximately in a position corresponding to the subsequent positions of the shell element when they finally form part of the roof of the shed or hall. Thus, the shell element may be set down in the form of rings (FIG. 6), in the form of an oval (FIG. 10), as a circle (FIG. 9), or as a series of straight lines or rows (FIG. 8). A first roof shell is fixed to the supports 30 of the hall or shed, possibly in a manner known per se, so that for example the lower shell elements of FIG. 4 are positioned.

The ends of the cables 9 depending from rollers 13 are hooked or otherwise anchored in their associated shell elements 14 (FIG. 13). The shell elements 14 may undergo preliminary positioning, on the floor of the hall or shed, so that the coupling or joint elements 16, 17 already partially engage in one another at this stage. The drive means 3, and, hence, the toothed ring 6. are driven, with the result that the winches 8 start to rotate, thereby tensioning the cables 9 and lifting the shell elements 14 (FIG. 5). In this way the shell elements 14 are simultaneously and slowly brought together in ring formation and coupled together in the ring plane (FIG. 3). Approximately simultaneously, and possibly with the assistance of an operative, the pins 21 are inserted into the elongate holes 22 of the sheet metal hooks 20 (FIG. 11). By appropriately engaging and disengaging the clutches 12 it is ensured that the shell elements are uniformly tightened or coupled together. The cables 9 are then raised to a further extent, so that the row of lower shell elements are upwardly swivelled, in the direction of arrow A (FIG. 4) and about swivel pins 21; thus the position of the lower shell elements is reversed, these elements being swivelled almost through a range of 180°, this swivelling movement continuing until spherical head 18 engages in hemispherical recess 19. The upper roof shell element 14 will now be supported or anchored from the lower roof shell element, and the fork 25 is then pulled out of its holder and inserted in retaining holes, for example holes 23 formed in the shell elements which have just been fixed in position in the roof being formed and form part of what is now the upper roof shell. One fork 25 is arranged to co-operate with each shell element 14. The end of the cable 9 is released and drops, as shown in FIG. 5; the next roof shell can now be assembled in position in the roof which is in process of formation.

Figure 7:
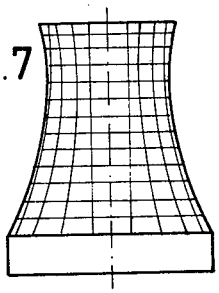
FIG. 7 is an elevation of a cooling tower, whose walls are formed by the method according to the invention.

It is apparent from the foregoing that the ring of shell elements which has been the last to be formed functions as a mast or as a jib. The invention is not restricted to this particular form of embodiment. Thus, the cables 9 may be run in grooves or channels 30 in the ground. Apart from compass (barrel) roofs, it is also possible to assemble shed (penthouse, lean-to) roofs (FIG. 8) or differently shaped roofs. The remaining opening may be closed off with a saucer dome (dome light). Apart from roofs (FIG. 7), other surfaces — which do not only serve as roofs — may be assembled. It is possible to use singly curved roof shells in addition to doubly curved roof shells. The multi-cable crane proposed according to the invention may also be used for other purposes, for example — when used in conjunction with the shell construction method, employing sliding (climbing) forms — for feeding concrete or other building materials. Then, instead of hooking the shell elements at the end of the cables or ropes 9, containers may be hooked to these cables or, for other practical applications, grippers or the like for tools or the like. The hulls of ships may also be made in accordance with the concept underlying the present invention. The roof shell may be preferred in a form in which it can be divided up into the individual roof shell elements by ring — or meridian-sections. Nevertheless the invention also includes cases in which the meridian radius becomes infinitely large, so that the side surface of the roof shell elements corresponds to a straight line (see FIG. 8). The particular structural materials selected will depend on the circumstances prevailing and includes roof shell elements made on a base of synthetic plastics materials or concrete. However, all other suitable structural materials may be used, such as wood, iron, glass, fibrous susbtances, or combinations of these materials.

What is claimed is:

1. In a method of constructing a composite structure from a plurality of shell elements, the steps of:

positioning below the structure to be erected a set of shell elements to constitute a course in the relative side-by-side positions corresponding to those positions to be occupied by the elements in the eventual structure;

raising those edges of all the shell elements of the course which are to be lower-most in the eventual structure to the level of the upper edge of the previously erected portion of the structure;

pivotably attaching said raised edges of the shell elements of the course to said previously erected structure;

raising the edges of the shell elements of the course opposite to said previously raised edges to pivot the shell elements of the course about said pivotably attachments into their desired erected positions; and securing the pivoted shell elements against other pivotable movement thereof.

2. The method of claim 1 including the step of at least partially securing together the adjacent edges of said shell elements in each course prior to raising such elements.

3. The method of claim 1 wherein all the shell elements of a course are pivoted simultaneously.

4. The method of claim 1 wherein the raising and pivoting steps are controlled from a central control point.

5. The method of claim 1 wherein the shell elements are raised from the central control point via the intermediary of a plurality of separately operable lifting cables and including the step of, raising containers charged with building materials to individual working sites via the intermediary of said separately operable lifting cables.

* * * * *